US005096393A

United States Patent [19]

Van Steenderen et al.

[11] Patent Number: 5,096,393

[45] Date of Patent: Mar. 17, 1992

[54] PERISTALTIC PUMP WITH HINGED ROTOR SUPPORT HOUSING AND ADJUSTABLE TUBE RACK

[75] Inventors: Ronald A. Van Steenderen; Andre K. Joubert, both of Transvaal Province, South Africa

[73] Assignee: CSIR, Pretoria, South Africa

[21] Appl. No.: 573,833

[22] Filed: Aug. 27, 1990

[30] Foreign Application Priority Data

Aug. 28, 1989 [ZA] South Africa ..... 89/6531
Oct. 2, 1989 [ZA] South Africa ..... 89/7471

[51] Int. Cl.[5] ..... F04B 43/12
[52] U.S. Cl. ..... 417/477; 604/153
[58] Field of Search ..... 417/475, 476, 477, 412; 604/153

[56] References Cited

U.S. PATENT DOCUMENTS

| | | | |
|---|---|---|---|
| 2,865,303 | 12/1958 | Ferrari et al. | 417/475 |
| 2,893,324 | 7/1959 | Isreeli et al. | 417/475 |
| 3,791,777 | 2/1974 | Papoff et al. | 417/475 |
| 4,233,001 | 11/1980 | Schmid | 417/475 |
| 4,522,570 | 6/1985 | Schartz | 417/475 |
| 4,604,038 | 8/1986 | Belew | 417/475 |

FOREIGN PATENT DOCUMENTS

| | | | |
|---|---|---|---|
| 239255 | 2/1986 | European Pat. Off. . | |
| 2025611 | 11/1970 | France | 417/475 |
| 81/00889 | 3/1982 | PCT Int'l Appl. . | |

OTHER PUBLICATIONS

Brochure Entitled "Desaga Peristaltic Pumps"; Product Information 163.
Brochure Entitled "Multi-Channel Peristaltic Pumps"; Offered for Sale by Ismatec.
Operating Instructions for Desaga PLG Multipurpose Peristaltic Pump 132100.
Brochure Entitled "Ismated Precision Metering Pumps".
Page 203 of Suid-Afrikaanse Tydskrif vir Wetenskap, vol. 85 (Apr. 1989).

*Primary Examiner*—Richard A. Bertsch
*Assistant Examiner*—David L. Cavanaugh
*Attorney, Agent, or Firm*—Dressler, Goldsmith, Shore, Sutker & Milnamow, Ltd.

[57] ABSTRACT

The invention provides a peristaltic metering pump for dosing metered quantitites of fluids along a plurality of flow lines. The pump comprises a set of rollers and a plurality of flexible liquid transfer tubes, the tubes being mounted on a tube mounting against which they are simultaneously compressed by the rollers. The rollers are drivingly connected to a motor, the rollers being mounted on a roller support. The motor is operable to drive the rollers so that they roll successively along the tubes and compress the tubes simultaneously against the tube mounting as they roll along the tubes. The roller support is biassed against a stop with the roller support being movable away from the stop against the bias by force exerted on at least one roller by the tubes.

12 Claims, 3 Drawing Sheets

PERISTALTIC PUMP WITH HINGED ROTOR SUPPORT HOUSING AND ADJUSTABLE TUBE RACK

This invention relates to a peristaltic pump. More particularly, the invention relates to a peristaltic dosing or metering pump, for dosing metered quantities of fluids along a plurality of flow lines.

According to the invention there is provided a peristaltic metering pump which comprises a set of rollers and a plurality of flexible liquid transfer tubes, the tubes being mounted on a tube mounting against which they are simultaneously compressed by at least one of the rollers, the rollers being drivingly connected to a motor, the rollers being mounted on a roller support, the motor being operable to drive the rollers so that they roll successively along the tubes and compress the tubes simultaneously against the tube mounting as they roll along the tubes, thereby to cause liquid flow in successive dosed amounts along the tubes, the roller support being biassed against a stop, and the roller support being movable away from the stop against the bias by force exerted on at least one roller by the tubes.

The pump may have an upright condition and a base for supporting it in said upright condition, the tube mounting being mounted on the base, the motor being mounted on the roller support and the upright condition being such that the roller support is biassed by gravity against the stop and such that the motor and rollers are located at a level above that of the tubes.

The tube mounting may comprise a frame or rack in which the tubes are arranged in parallel spaced relationship, the frame or rack being adjustably movable in the direction in which the tubes extend, thereby to vary the parts of the tubes compressed by the rollers, to compensate for wear on the tubes by the rollers. The frame or rack may be mounted on said base.

The motor and the rollers may be enclosed in a housing providing the roller support, said roller support being pivotally mounted so that it is pivotable away from the stop to move the rollers out of contact with the tubes. The roller support may thus be pivotable upwardly away from the stop, and the housing preferably encloses the entire drive between the motor and the rollers, so that the rollers, motor and drive are enclosed and mounted as a unit on the roller support, the roller support resting under gravity on the stop on the base and being pivotable upwardly into an inoperative position in which access is provided to the rollers, drive and motor on the one hand, and to the tubes on the other hand.

The roller support may comprise a frame which is biassed downwardly against the stop, the tubes being compressed downwardly against the tube mounting with the roller or rollers pressing downwardly on the tubes. The stop may be provided on the base.

The rollers may be equally circumferentially spaced from one another in series, in planetary fashion about a central common orbital axis, each roller being rotatably mounted about a spin axis parallel to the orbital axis, the rollers being drivingly connected to the motor by a drive whereby the rollers are operatively interconnected for simultaneous spinning thereof by the motor in the same rotational direction about their individual spin axes while the rollers are simultaneously orbited bodily about the central orbital axis by the motor in the opposite rotational direction to that of the spin of the rollers about their spin axes, so that the rollers are successively moved into contact with the tubes and roll along the tubes, after which they are successively moved out of contact with the tubes, the drive being arranged so that the rate of spinning is matched to the rate of orbiting, to resist slipping of the rollers over the tubes as they roll along the tubes. In this way slippage of the rollers along the tubes can be reduced towards a minimum. Suitable planetary gearing, which may be connected to the motor via a gearbox, may be provided to spin the rollers about their spin axes while orbiting them about the orbital axis. Preferably, however, the rollers are spun by a plurality of drive belts driven by the motor, optionally via a gearbox. The belts may be steel reinforced. The gearbox may be a variable speed gearbox, and/or the motor may be an electric motor which may be a variable speed motor, so that, either way, there is a variable speed drive to the rollers.

Each tube may be compressed against a tube support forming part of the tube mounting, and the tube support being resiliently biassed towards the rollers (e.g. by spring loading). The resilient biassing of the tube may be adjustable. The tube support may be in the form of a lever pivotally mounted about a pivot axis, the resilient biassing of the tube support being adjustable by pivoting the tube support about its pivot axis. Each tube may have its own individual tube support associated therewith, separate from the tube supports of the other tubes, and each may be in the form of a said lever. The levers may be arranged in parallel array. Each tube support may be, at least in part, arcuate and upwardly concave in shape, the associated tube being compressed against said arcuate concave part of the support. Said curved portion may be curved about an axis which coincides with or is parallel to and closely spaced from, the orbital axis of the set of rollers.

The pump may include suitable electronic monitoring means for monitoring the rate of operation of the pump and dosages delivered thereby, being connectable e.g. to a suitable computer for recording and/or analysing said rate of operation and dosages delivered.

The invention will now be described, by way of example, with reference to the accompanying schematic drawings, in which.

Figure 2:
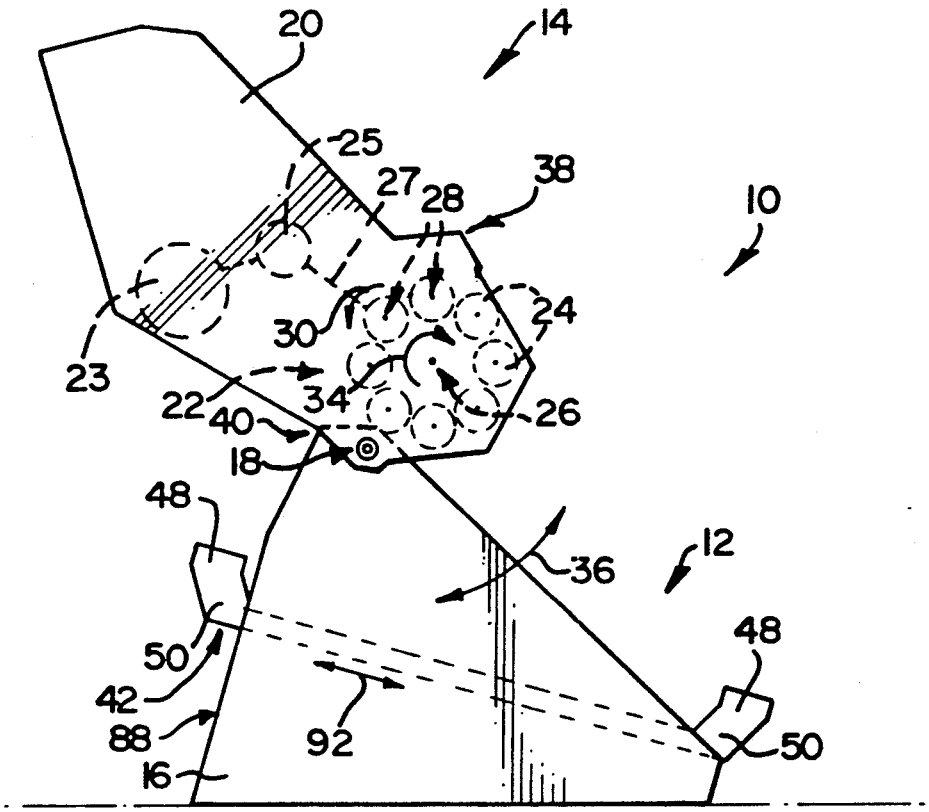
FIG. 2 shows the same view as FIG. 1 but with the set of rollers in its inoperative condition.
Figure 1:
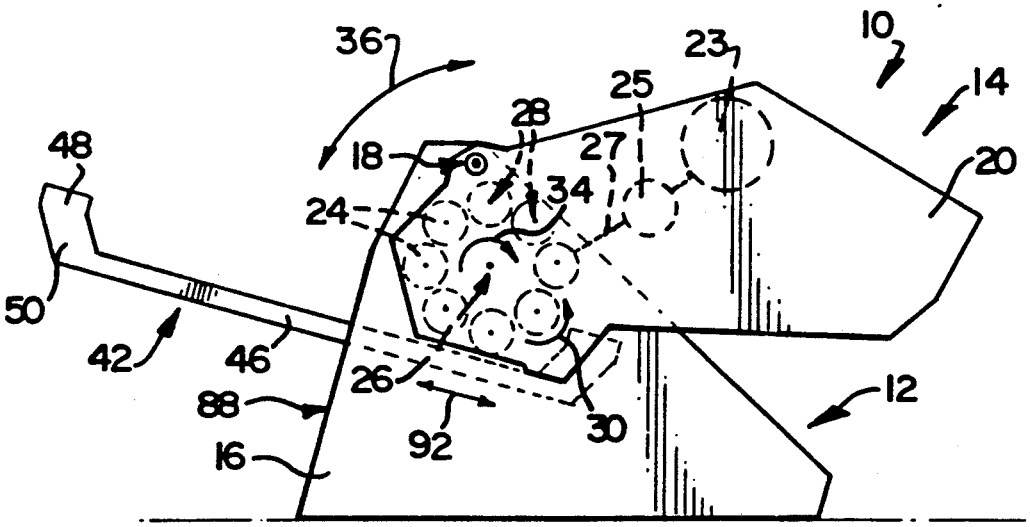
FIG. 1 shows a side elevation of a peristaltic pump according to the invention, with its set of rollers in its operative condition.

In FIGS. 1 and 2 of the drawings, reference numeral 10 generally designates a peristaltic metering pump in accordance with the invention, suitable for dosing metered quantities of liquids along a plurality of flow lines. The pump comprises, broadly, two units, namely a base 12 for supporting the pump in an upright condition on a flat horizontal support surface, and a pivotable unit 14 pivotally connected to the base.

The base 12 has a floor and a pair of spaced side walls 16, of more or less triangular shape, the unit 14 being pivotally connected to the base 12 by a pivot axis at 18, passing through the walls 16 adjacent their upper apexes.

The unit 14 has a housing in the form of a hollow sheet metal cover 20, which forms an enclosure, and the unit provides a roller support within which are mounted a set 22 of rollers, described in more detail hereunder, together with a suitable variable speed electric motor 23 [broken lines], a gearbox 25 [broken lines] and an electronic device [not shown]. Instead or in addition, the gearbox may be a variable speed gearbox. The motor is drivingly connected in permanent fashion via the gearbox to the set 22 of rollers; and the monitoring device in turn is connected to one or more of said motor, gearbox and/or set 22 of rollers, to monitor the operation thereof, e.g. the speed of operation and/or duration of operation, so as to monitor the operation of the pump 10. This monitoring device can be adapted for connection to a suitable computer, such as a personal computer [PC] for recording details of pump operation monitored thereby.

The set 22 of rollers is of more or less conventional construction, comprising eight cylindrical rollers 24 arranged in a ring, parallel to one another, being equally circumferentially spaced in series from one another about a central orbital axis 26. The rollers 24 are operatively interconnected for simultaneous spinning thereof about their spin axes 28, at the same speed and in the same direction, indicated by arrow 30, by the gearbox; and the set of rollers is also constructed to cause the rollers 24 to orbit bodily, as they spin, about the orbital axis 26, in the opposite direction, as indicated by arrow 34. Spinning the rollers is achieved by means of a belt drive (shown schematically in broken lines at 27) connecting them to the gearbox by means of a steel reinforced belt. Naturally, instead, the drive may be by means of suitable planetary gearing which interconnects the rollers and drivingly connects them to the gearbox.

The housing provides a roller support in the form of a frame, which frame is pivotable in the direction of arrow 36 about pivot axis 18, between an operative condition in which the cover 20 rests on the base 12 [as shown in FIG. 1], and an inoperative raised and upwardly pivoted condition [as shown in FIG. 2], to provide access downwardly into the interior of the base 12, and access downwardly into the interior of the cover 20. In its closed operative condition the unit 14 rests under gravity on the base 12; and in its inoperative condition, which is overcentre relative to the operative condition, it is also held by gravity, making contact with the base at 40, so that the base supports it as shown in FIG. 2.

The walls 16 of the base 12 are suitably interconnected by cross members [not shown], so that the base is a hollow framework, to the interior of which access is possible from above and from the front and rear.

In the interior of the base 12 is located a tube mounting. The tube mounting comprises a rack or frame on which is mounted an array of tubes, the tube mounting thereon being described in more detail hereunder, and designated generally by reference numeral 42 in FIG. 3, and an array of supports for the tubes, also described in more detail hereunder and designated generally by reference numeral 44 in FIG. 4. The tube mounting 42 and array 44 are mounted on the base 12.

Figure 3:
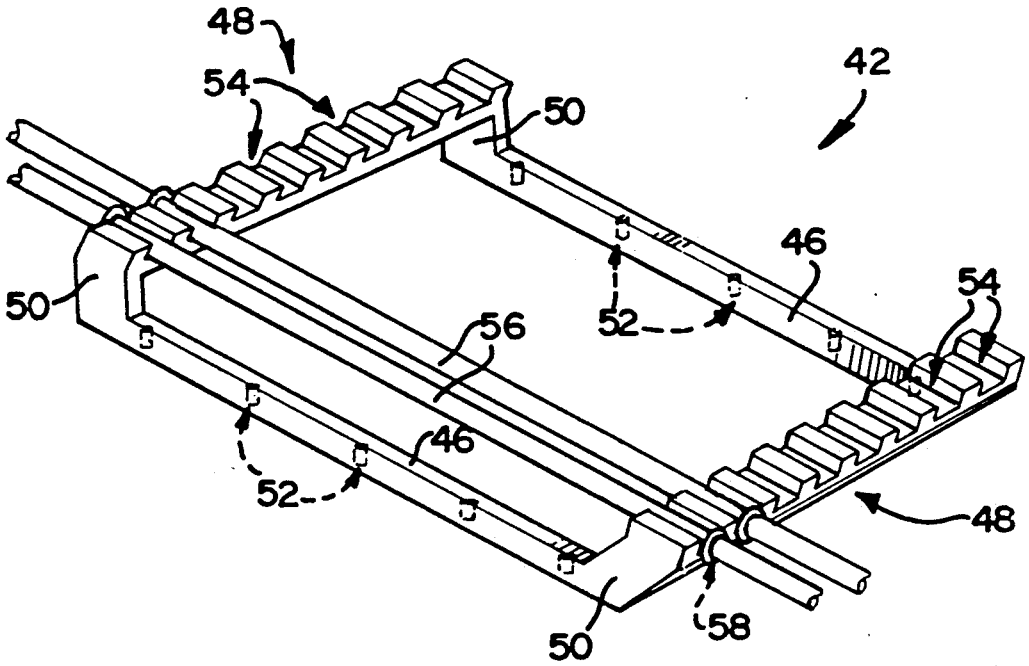
FIG. 3 shows a schematic three dimensional view of the rack of the pump of FIGS. 1 and 2.

Turning now to FIG. 3, the tube mounting 42 is in the form of a unit comprising an open frame or rack, the frame being defined by a pair of spaced parallel elongated side members 46, whose ends are interconnected to the ends of a pair of spaced parallel cross- or end members 48. The ends of the members 46 are cranked as at 50, so that the members 48 are offset upwardly relative to the members 46, and are in a plane which is raised above the plane in which the members 46 are located.

Each of the members 46 has, on its underside, a row of longitudinally evenly spaced downwardly opening blind sockets 52, whose function will be described hereunder. Each of the members 48 has, in turn, a series of upwardly facing parallel channels 54, spaced along its upper surface, the channels 54 being of rectangular cross-section and extending parallel to the members 46. The channels 54 in the two members 48 are arranged in a series of registering pairs, each channel 54 in the one member 48 being longitudinally aligned with a registering channel 54 in the other member 48, the two aligned channels 54 forming one of said registering pairs.

The array of tubes comprises a plurality of parallel flexible plastics tubes 56 [not all shown in FIG. 3], which are respectively held captive in each of said pairs of registering channels 54. The tubes 56 are each held in place by suitable clamps, in the drawing shown as O-rings 58 which encircle and lightly frictionally embrace the tubes, an O-ring 58 being provided at the longitudinally outer end of each channel 54, where it engages the outer surface of the associated member 48 at the periphery of the end of the channel 54. Each tube 56 is held in the rack or frame by its pair of O-rings 58 under slight tension, so that the tubes 56 are extended parallel to one another, as shown in FIG. 3.

Figure 4:
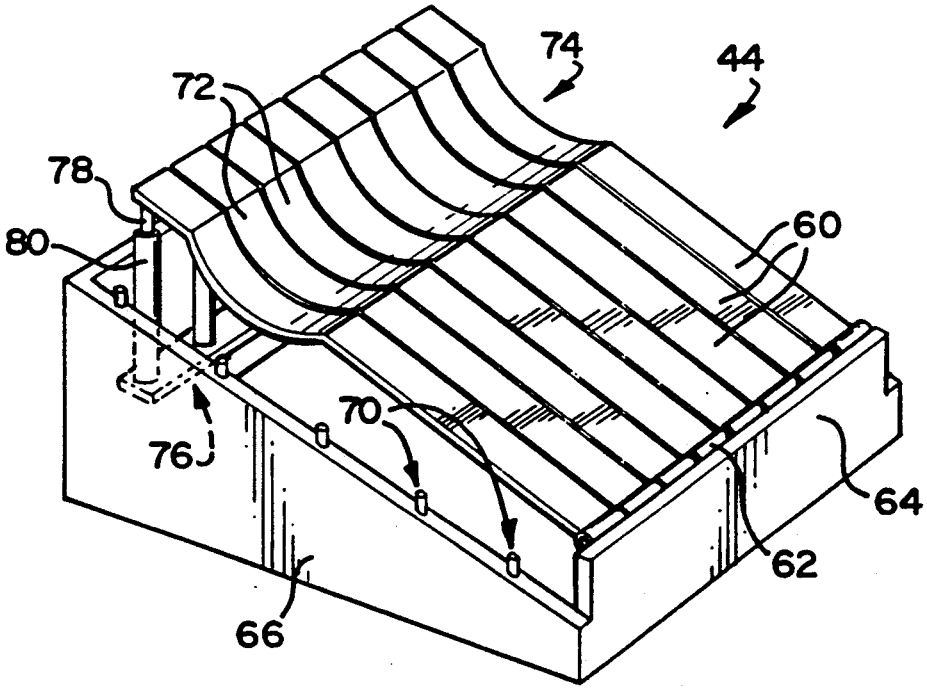
FIG. 4 shows a schematic three dimensional view of the array of supports of the pump of FIGS. 1 and 2.

Turning to FIG. 4, the array 44 comprises a plurality of elongated supports 60 in the form of levers. The levers are arranged side-by-side in parallel fashion with a slight clearance therebetween, and are all pivotally connected at one end thereof to a pivot pin 62. The pivot pin 62 in turn is mounted on the inner surface of the top of a wall 64 which forms an end wall of an open box-like frame having a pair of parallel spaced side walls 66, and a further end wall 68, spaced from and parallel to the wall 64.

The side walls 66 are trapezoidal in shape, and have sloping tops which slope downwardly from opposite ends of the top of the end wall 68, to the ends of the end wall 64, where they terminate at a position spaced between the top and bottom of the wall 64, so that the wall 64 projects upwardly above the adjacent ends of the walls 66. Each of the walls 66 has, evenly spaced along its upper surface, a series of pins or pegs 70, which are matingly receivable in the sockets 52 of the members 46 of the frame 42 shown in FIG. 3; and the spacing of the pegs 70 from one another is the same as the spacing between the sockets 52.

Each of the supports 60 has, adjacent and spaced from its end remote from the pivot pin 62, a downwardly offset arcuate portion 72, which is part-circular in shape and has its concave face facing upwardly. The portions 72 are aligned in register with one another in a horizontal direction parallel to the pin 62, so that they combine to form a shallow curved upwardly facing channel 74 as shown in FIG. 4. The walls 66 are shown interconnected by a cross-member or beam 76, parallel to the end walls 64, 68, the beam 76 being spaced between the top and bottom of the side walls 76, adjacent and spaced from the end wall 68.

Each of the supports 60 is in turn supported on individual resilient biassing means in the form of an upwardly projecting pin 78 axially slidable piston and cylinder fashion in a tube 80. The tubes 80 in turn are supported at their lower ends in series on the beam 76. Each pin 78 projects partially upwardly out of its associated tube 80 and has its lower end supported on a coil spring 82 [see also FIG. 5] under compression. The lower end of each coil spring 82 rests on a stop 84 in the tube which is clamped to the tube by a grub screw 86 having a head outside the tube and a threaded stem passing into the tube through a vertical slot [not shown] in the tube, to engage a threaded passage in the stop 84.

Figure 5:
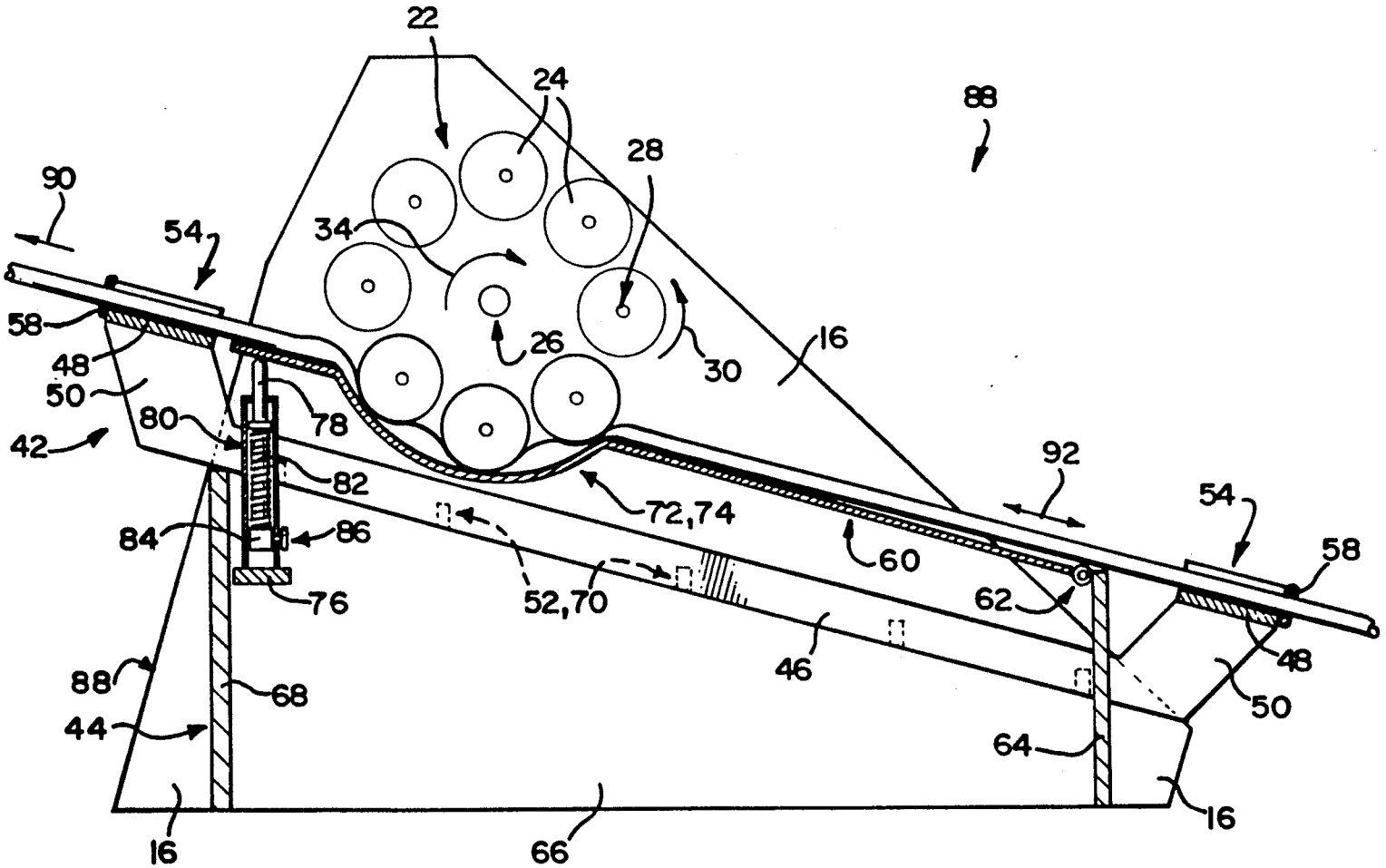
FIG. 5 shows in sectional side elevation a detail illustrating the arrangement of one of the supports of the array of FIG. 4.

In the assembled state of the pump, the array 44 is releasably mounted in the interior of the base 12, its walls 66 being closely spaced from and opposed to the walls 16 of the base, with its end wall adjacent the edges 88 [see FIGS. 1, 2 and 5] of the walls 16, and with the bottom of its walls 64, 66 and 68 resting on the floor of the base 12.

The frame 42 of FIG. 3 and the associated tubes in turn rest on the array 44, with the lower surfaces of the members 46 resting on the upper surfaces of the walls 66, at least some of the pegs 70 engaging at least some of the sockets 52. In use at least one, and usually both, of the members 48 of the frame 42 will project outwardly in a fore and aft direction, from the interior of the base 12, as shown in FIGS. 1 and 2, depending on how many, and which, of the pegs 70 engage the sockets 52.

With the unit 14 in its operative condition [FIG. 1], the set 22 of rollers 24 has the lower part of its periphery in end elevation in register with and received in the channel 74 [FIG. 4] defined by the arcuate portions 72 of the supports 60, with the centre of curvature of the portions 72 and channel 74 coinciding with the orbital axis 26. The pins 78 resiliently bias the respective associated supports upwardly against several of the rollers 24. In this condition the unit 14, at 38 on its cover 20, rests on the members 46 of the frame 42, holding the frame 42 firmly down under gravity on the array 44. The members 46 of the frame 42 accordingly provide stops against which the unit 14 is firmly biassed downwardly by gravity.

With reference also to FIG. 5, in which a detail of the pump 10 is shown by reference numeral 88, the same reference numerals being used to designate the same parts as in FIGS. 1 to 4 unless otherwise specified, it will be appreciated that there is a tube 56 corresponding to and in vertical register with each support 60, there being the same number of tubes 56 as supports 60. The supports 60 each bear upwardly on and compress the associated tube 56, and urge it resiliently against the rollers 24 which intrude into the channel 74. The force with which each support 60 compresses its tube 56 against said rollers 24 is determined by the degree of compression in the spring 82 of the associated pin 78 which bears resiliently upwardly on the support 60 in question. As can be seen from FIGS. 4 and 5, the beam 76 is located under the supports 60 at a position between the channel 74 and the free ends of the supports remote from the pivot pin 62, and each pin 78 bears upwardly on the associated support 60 at a position between the arcuate portion 72 and free end of that support 60.

To adjust the degree of compression of any tube 56, the associated grub screw can be loosened and moved up or down in its slot before being retightened, thereby respectively either to increase or reduce the degree of compression in the associated spring 82, and the force with which it urges the associated pin 78 upwardly to compress the tube 56, via the associated support 60, against the rollers 24.

In this regard it should be appreciated that the tubes 56 need not all be of the same size or of the same plastics material, so that the springs 82 need not all have the same compression and the tubes 56 need not all be compressed to the same degree. Furthermore, it should be noted that the combined upward force of the springs should be set at a value which is insufficient to pivot the unit 14 [FIG. 1] in the direction of arrow 36, upwardly off the base and out of contact at 40 with the base 12.

In use, with the unit 14 in its operative condition [see FIGS. 1 and 5] the electric motor orbits, via the gearbox and planetary gearing, the set 22 of rollers in the direction of arrow 34 abut the orbital axis 26, while simultaneously spinning the rollers 24 about their spin axes 28 in the direction of arrow 30. The respective rates of orbiting and spinning are such that the rollers 24 roll along the tubes 56 in the channel 74 formed by the arcuate portions 72 of the supports 60, with little, if any, slippage, thereby to pump slugs of liquid along the tubes 56 in the direction of arrow 90 [FIG. 5].

As indicated above, different sizes and types of tubes 56 may be used simultaneously for different fluids or for dosing the same fluid at different rates through different tubes. The motor or gearbox can be used to vary simultaneously the rate or orbiting or the set 22 and, correspondingly, the rate of spin of the rollers 24. The monitoring device will typically monitor operation of the pump, and transmit the parameters which are monitored to a PC where they can be recorded, stored, analysed, etc.

Prior to start-up of the pump, and from time to time thereafter as necessary, the compression in the springs 82 can be adjusted to suitable values to give each tube 56 a desired degree of compression between its support 60 and the rollers 24, so that a desired flow rate is achieved along the tube, dependent on the rate of orbiting.

Some wear and fatigue of the tubes 56 will inevitably occur sooner or later, caused by rubbing and/or rolling of the rollers 24 thereon. When the tubes are sufficiently worn, the position of the frame 42 on the array 44 can be adjusted in the direction of arrow 92 [FIGS. 1, 2 and 5]. This is done by lifting the frame 42 upwardly off the array 44 to disengage the pegs 70 from the sockets 52, moving the array in the direction of arrow 92, and then replacing the array in a new position on the array 44. After readjusting the compression in the springs 82, if necessary, the pump can again be set in operation, but with the rollers 24 engaging unworn parts of the tubes. Naturally, when all the parts of the tubes 56 which can be engaged by the rollers 24 have become worn, the tubes will have to be replaced.

Although the springs 82 in the tubes are described as being adjustable and as resting on the beam 76, the beam 76 and adjustibility of the springs can be omitted, if desired, and longer non-adjustable springs 82 in longer tubes 80 can be mounted directly on the floor of the base 12, to which floor the frame of the array 44 can be connected. It should be noted that, whether the springs 82 are of this alternative construction or one of the constructions as shown in the drawings, the arrangement should be such that, if any of the tubes 56 is omitted, the spring 82 of the associated support 60 does not urge the support into contact with the rollers 24.

The pump 10 shown in the drawings has a number of surprising and advantageous features. Thus, with the tubes 56 located at a level below the set 22 of rollers 24 and below the motor, drive, rollers and monitoring device, danger of any soiling of the motor, its gearbox, belts or other drive, the rollers and the monitoring device, or damage thereto, by pumped liquid, is reduced in the event of a burst pipe 56. Secondly, and importantly, the service life of the pump and particularly its tubes is increased by adjusting the position of the frame 42 on the frame 44, as described above. As a particular advantage it must be emphasized that no positive locking of the unit 14 and its set 22 of rollers 24 to the base 12 in the operative condition of the pump is provided, the unit 14 automatically assuming the correct position against the stops 46 on the base by virtue of its own mass under gravity. In the event that any obstruction, e.g. solid material being carried along the interior of the tubes 56 by liquid flowing along the tubes, tends to jam the rollers, by lodging between the rollers 24 on the one hand and the tubes 56 or their supports 60, and if the compressibility of the springs 82 is insufficient to prevent this jamming, the unit 14 can simply rise up over the obstruction and roll over it. This resists damage to or destruction of the rollers, motor or associated drive, or damage to the tube mounting or tubes. The force exerted on the rollers by any obstruction tending to jam them against the tubes can thus easily be relieved by upward pivoting of the unit 14, against the bias exerted by gravity which urges the rollers 24 against the tubes, upwardly and away from the stops provided by the members 46 of the frame 42.

Furthermore, the adjustability of the compression in the springs 82 can easily be limited to prevent the supports 60 from being pushed with too much force against the tubes 56 and rollers 24, this feature also protecting the motor, drive and set 22 of rollers 24 from strain and abuse; and in this regard it should be noted that replacement of pipes is quick and easy and can be effected simply by lifting the unit 14 and lifting a pipe 56 to be replaced from its channels 54, and then inserting a new pipe 56, and it is in particular to be noted that this can be done without disconnecting the set 22 of rollers from the drive or motor. The drive train between the motor and rollers 24 is thus permanently connected and is not prone to be disturbed after it has initially been properly set up and connected during initial assembly. Long service lives of the motor, drive and set 22 of rollers 24 are thus promoted. Drive belts between the motor or gearbox and the rollers can also easily be replaced, if necessary, with the unit 14 in its inoperative condition.

What is claimed is:

1. A peristaltic metering pump which comprises a set of rollers and a plurality of flexible liquid transfer tubes, the tubes being mounted on a tube mounting against which they are simultaneously compressed by at least one of the rollers, the rollers being drivingly connected to a motor, the rollers being mounted on a roller support, the motor being operable to drive the rollers so that they roll successively along the tubes and compress the tubes simultaneously against the tube mounting as they roll along the tubes, thereby to cause liquid flow in successive dosed amounts along the tubes, the tube mounting comprising a frame in which the tubes are arranged in parallel spaced relationship, the frame being adjustably movable in the direction in which the tubes extend, thereby to vary the parts of the tubes compressed by the rollers.

2. A peristaltic metering pump which comprises a set of rollers and a plurality of flexible liquid transfer tubes, the tubes being mounted on a tube mounting against which they are simultaneously compressed by at least one of the rollers, the rollers being drivingly connected to a motor, the rollers being mounted on a roller support that is freely mounted relative to said tube mounting, the motor being operable to drive the rollers so that they roll successively along the tube mounting as they roll along the tubes, thereby to cause liquid flow in successive dosed amounts along the tubes, the roller support being biased against a stop, and the roller support being movable away from the stop against the bias by force exerted on at least one roller by the tubes, the stop being fixedly mounted relative to said rube mounting in the direction in which the roller support is movable towards said tube mounting.

3. A pump as claimed in claim 2, which has an upright condition and a base for supporting it in said upright condition, the tube mounting being mounted on the base, the motor being mounted on the roller support and the upright condition being such that the roller support is biassed by gravity against the stop and such that the motor and rollers are located at a level above that of the tubes.

4. A pump as claimed in claim 1, in which the tube mounting comprises a frame or rack in which the tubes are arranged in parallel spaced relationship, the frame or rack being adjustably movable in the direction in which the tubes extend, thereby to vary the parts of the tubes compressed by the rollers, to compensate for wear on the tubes by the rollers.

5. A pump as claimed in aclaim 2, in which the motor and rollers are enclosed in a housing providing the roller support, said roller support being pivotally mounted so that it is pivotable away from the stop to move the rollers out of contact with the tubes.

6. A pump as claimed in claim 2, in which the roller support comprises a frame which is biassed downwardly against the stop, the tubes being compressed downwardly against the tube mounting.

7. A pump as claimed in claim 2, in which the rollers are equally circumferentially spaced from one another in series, in planetary fashion about a central common orbital axis, each roller being rotatably mounted about a spin axis parallel to the orbital axis, the rollers being drivingly connected to the motor by a drive whereby the rollers are operatively interconnected for simultaneous spinning thereof by the motor in the same rotational direction about their individual spin axes while the rollers are simultaneously orbited bodily about the central orbital axis by the motor in the opposite rotational direction to that of the spin of the rollers about their spin axes, so that the rollers are successively moved into contact with the tubes and roll along the tubes, after which they are successively moved out of contact with the tubes, the drive being arranged so that the rate of spinning is matched to the rate of orbiting, to resist slipping of the rollers over the tubes as they roll along the tubes.

8. A pump as claimed in claim 2, in which each tube is compressed against a tube support forming part of the tube mounting, and the tube support being resiliently biassed towards the rollers.

9. A pump as claimed in claim 8, in which the resilient biassing of the tube support is adjustable.

10. A pump as claimed in claim 9, in which the tube support is in the form of a lever pivotally mounted about a pivot axis, the resilient biassing of the tube support being adjustable by pivoting the tube support about its pivot axis.

11. A pump as claimed in claim 8, in which each tube has its own individual tube support associated therewith, separate from the tube supports of the other tubes.

12. A pump as claimed in claim 8, in which each tube support is, at least in part, arcuate and upwardly concave in shape, the associated tube being compressed against said arcuate concave part of the support.

* * * * *